US012012969B2

(12) United States Patent
Chen et al.

(10) Patent No.: US 12,012,969 B2
(45) Date of Patent: Jun. 18, 2024

(54) PROPELLER FAN

(71) Applicant: DAIKIN INDUSTRIES, LTD., Osaka (JP)

(72) Inventors: Zuozhou Chen, Osaka (JP); Anan Takada, Osaka (JP); Tomohiro Ishibashi, Osaka (JP); Tooru Iwata, Osaka (JP); Kaname Maruyama, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/125,573

(22) Filed: Mar. 23, 2023

(65) Prior Publication Data

US 2023/0228278 A1 Jul. 20, 2023

Related U.S. Application Data

(63) Continuation of application No. PCT/JP2021/018644, filed on May 17, 2021.

(30) Foreign Application Priority Data

Sep. 29, 2020 (JP) ..... 2020-163792

(51) Int. Cl.
*F04D 29/32* (2006.01)
*F04D 19/00* (2006.01)

(52) U.S. Cl.
CPC ..... *F04D 29/325* (2013.01); *F04D 19/002* (2013.01)

(58) Field of Classification Search
CPC .... F04D 29/325; F04D 29/326; F04D 29/384; F04D 19/002; F05D 2240/304
See application file for complete search history.

(56) References Cited

U.S. PATENT DOCUMENTS 6,241,474 B1 * 6/2001 Alizadeh ..... F04D 29/326 416/223 R
2007/0201982 A1 * 8/2007 Neumeier ..... F04D 29/681 416/142
2019/0316599 A1 10/2019 Iwata et al.

FOREIGN PATENT DOCUMENTS

JP 2018-109393 A 7/2018

OTHER PUBLICATIONS

International Search Report of corresponding PCT Application No. PCT/JP2021/018644 dated Jul. 13, 2021.

(Continued)

*Primary Examiner* — Elton K Wong
(74) *Attorney, Agent, or Firm* — Global IP Counselors, LLP

(57) ABSTRACT

A propeller fan includes a hub rotatable about an axis, and a plurality of blades extending radially outward from an outer peripheral surface of the hub. A ring surrounds the plurality of blades and is connected to each blade tip. A maximum camber location is on a camber line where a distance from a chord line to the camber line in an arc-shaped cross section of each blade about the axis is maximum. An axial height is from a trailing edge to the camber line in a direction along the axis. Each blade has a first portion provided inside in the radial direction of rotation and whose axial height at the maximum camber location is substantially constant, and a second portion provided outside in the radial direction of rotation and whose axial height at the maximum camber location increases toward the blade tip.

20 Claims, 10 Drawing Sheets

(56) References Cited

OTHER PUBLICATIONS

International Preliminary Report of corresponding PCT Application No. PCT/JP2021/018533 dated Apr. 13, 2023.
European Search Report of corresponding EP Application No. 21 87 4807.7 dated Feb. 15, 2024.

* cited by examiner

PROPELLER FAN

CROSS-REFERENCE TO RELATED APPLICATIONS

This is a continuation of International Application No. PCT/JP2021/018644 filed on May 17, 2021, which claims priority to Japanese Patent Application No. 2020-163792, filed on Sep. 29, 2020. The entire disclosures of these applications are incorporated by reference herein.

BACKGROUND

Technical Field

The present disclosure relates to a propeller fan.

Background Art

Conventionally, there has been proposed a technique for enhancing a fan efficiency in a propeller fan having a plurality of blades. For example, Japanese Unexamined Patent Publication No. 2018-109393 discloses a propeller fan for which blades are designed to reduce generation of a blade tip vortex that may lead to degradation of a fan efficiency. The blade tip vortex is a vortex flow generated by air that flows back around a blade tip from a positive pressure surface side to a negative pressure surface side of the blade. The blade tip vortex expands, at the blade tip, with an increase in a distance between a maximum camber location and the trailing edge of the blade.

In the propeller fan of Japanese Unexamined Patent Publication No. 2018-109393, each blade is designed as follows: The maximum camber location ratio gradually increases from a blade root toward the blade tip to keep the maximum camber location from being greatly separated from the trailing edge on the blade tip side. Here, the maximum camber location ratio is the ratio of the distance from a leading edge to the maximum camber location with respect to a chord line length in the blade cross section. The maximum camber location is a location on the chord line where a camber height in the blade cross section is maximum. The camber height is the distance from the chord line to a camber line in the blade cross section.

SUMMARY

A first aspect of the present disclose is directed to a propeller fan including a hub configured to rotate about an axis, and a plurality of blades extending outward in a radial direction of rotation from an outer peripheral surface of the hub. A ring is provided to surround the plurality of blades that is connected to each blade tip, which is an outer end of each blade in the radial direction of rotation. A maximum camber location is on a camber line where a distance from a chord line to the camber line in an arc-shaped cross section of each blade about the axis is maximum. An axial height is from a trailing edge, which is a rear edge of each blade in a rotation direction thereof, to the camber line in a direction along the axis. Each blade has a first portion provided inside in the radial direction of rotation and whose axial height at the maximum camber location is substantially constant, and a second portion provided outside in the radial direction of rotation and whose axial height at the maximum camber location increases toward the blade tip.

DETAILED DESCRIPTION OF EMBODIMENT(S)

Embodiments

Exemplary embodiments will now be described with reference to the drawings.

Figure 1:
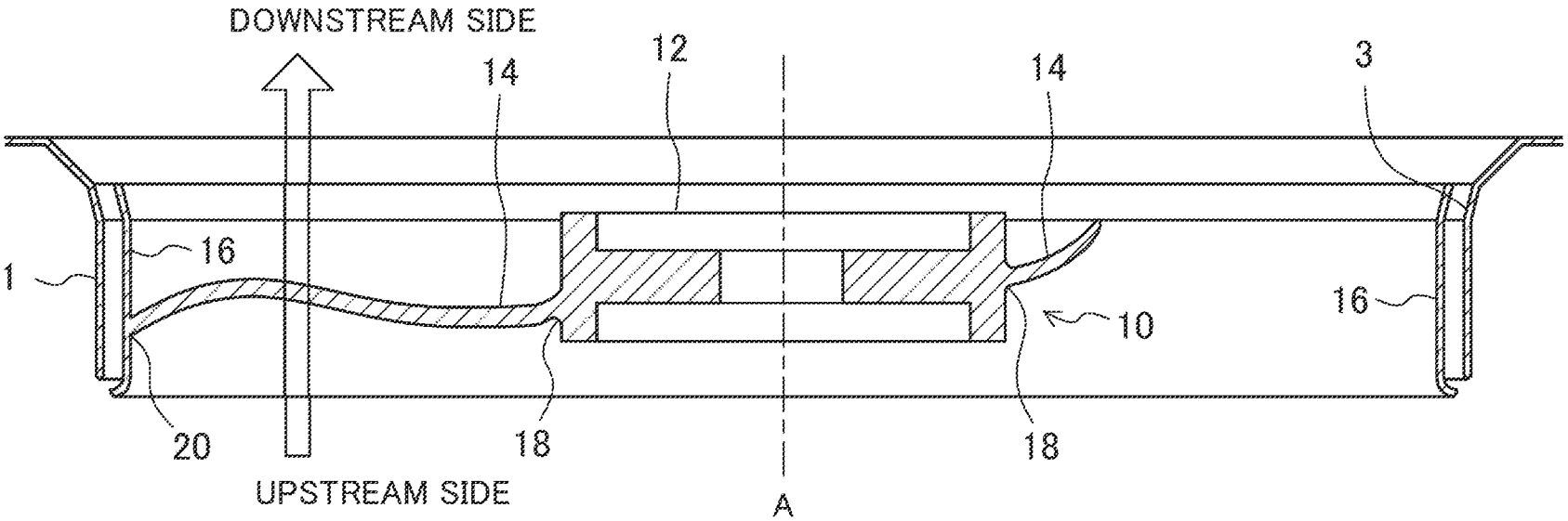
FIG. 1 is a cross-sectional view of a propeller fan disposed in an annular bell mouth in accordance with an embodiment.

A propeller fan of this embodiment is used for an air blowing device. The air blowing device is provided, for example, in a heat source unit of an air conditioner, and is for supplying outdoor air to a heat-source-side heat exchanger. The air blowing device includes a bell mouth (1) formed into an annular cylindrical shape and illustrated in FIG. 1. The bell mouth (1) forms an air blowing port (3) for blowing air. The propeller fan (10) is arranged in such a state that a ring (16) faces the inside of the bell mouth (1).

Propeller Fan Configuration

Figure 2:
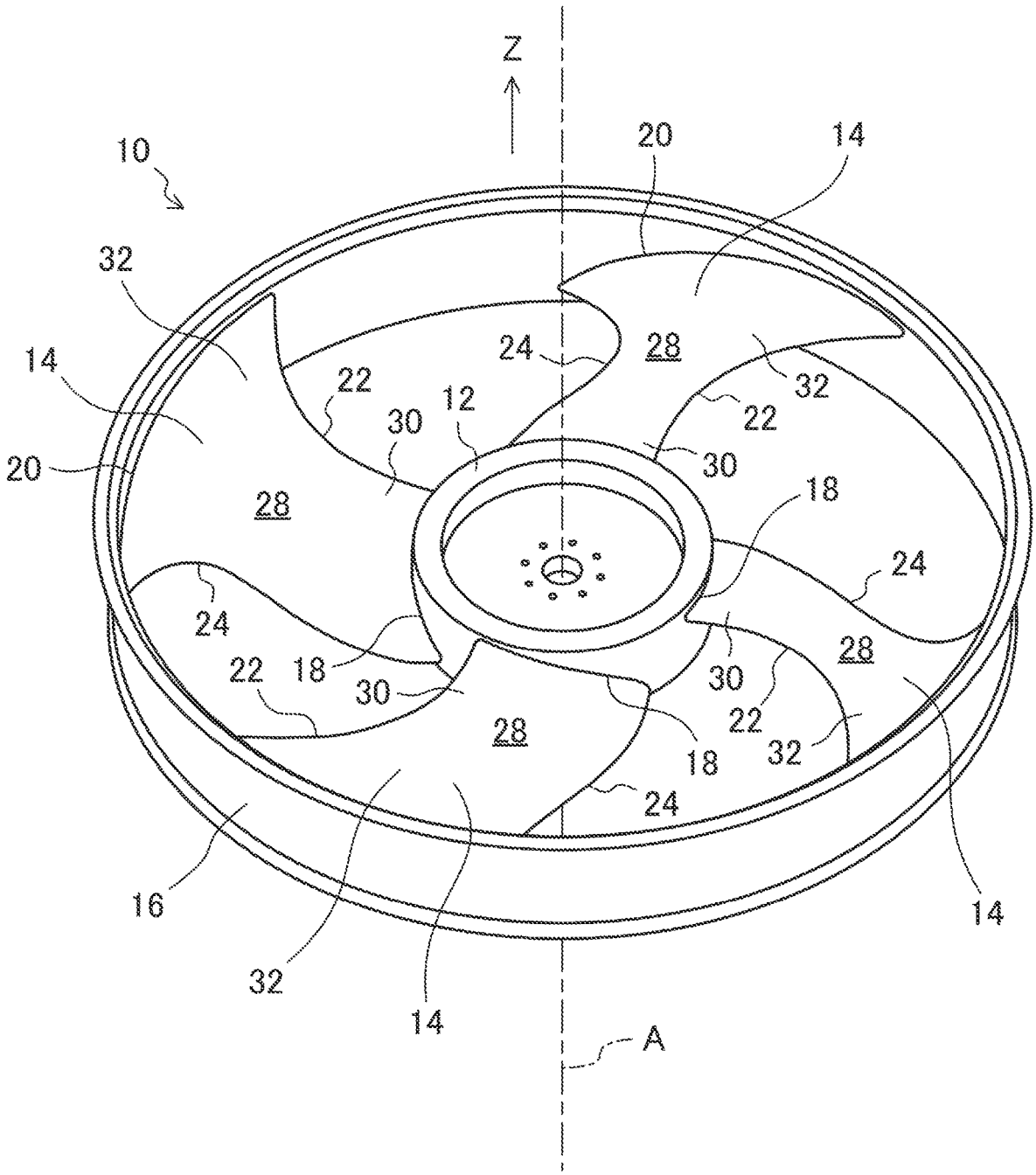
FIG. 2 is a perspective view illustrating, as an example, the propeller fan of the embodiment.
Figure 3:
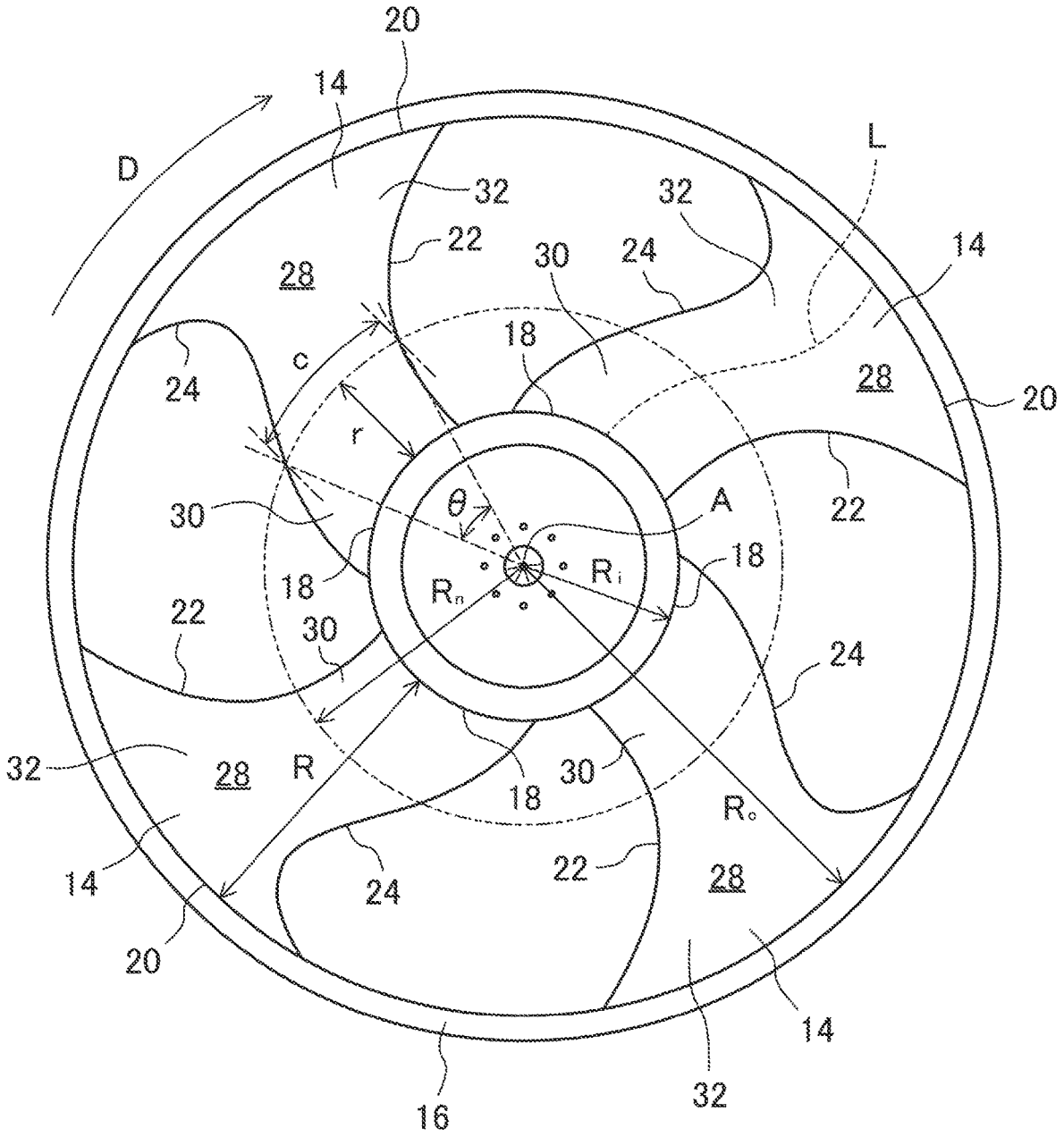
FIG. 3 is a back view illustrating, as an example, the propeller fan of the embodiment.

The propeller fan (10) is an axial flow fan made of synthetic resin. As illustrated in FIGS. 2 and 3, the propeller fan (10) includes one hub (12), four blades (14), and one ring (16). The one hub (12), the four blades (14), and the one ring (16) are integrally formed. The propeller fan (10) is formed by, for example, injection molding.

The hub (12) is formed into a cylindrical shape. The hub (12) is a shaft portion of the propeller fan (10), and is located at a center part of the propeller fan (10). A drive shaft of a fan motor (not shown) is attached to the hub (12). The hub (12) is driven by the fan motor to rotate around an axis (A). The center axis of the hub (12) coincides with the axis (A) of the propeller fan (10).

The four blades (14) are arranged at regular angular intervals in the circumferential direction of the hub (12). Each blade (14) extends outward in the radial direction of rotation from the outer peripheral surface of the hub (12). The four blades (14) extend radially outward from the hub (12) in the radial direction of the propeller fan (10). The adjacent blades (14) do not overlap each other in a front view or a rear view. Each blade (14) is formed into a plate shape smoothly curved along the radial direction of rotation and a rotation direction (D). The four blades (14) have the same shape.

The end of each blade (14) closer to the center of the propeller fan (10) in the radial direction thereof, i.e., the inner end in the radial direction of rotation, is a blade root (18). The end of each blade (14) closer to the outside of the propeller fan (10) in the radial direction thereof, i.e., the outer end in the radial direction of rotation, is a blade tip (20). The blade root (18) and blade tip (20) of each blade (14) extend along the rotation direction (D) of the propeller fan (10).

The blade root (18) of each blade (14) is connected to the hub (12). In each blade (14), the distance Ri from the axis (A) of the propeller fan (10) to the blade root (18) of the propeller fan (10) is substantially constant over the entire length of the blade root (18). The blade tip (20) of each blade (14) is connected to the ring (16). In each blade (14), the distance Ro from the axis (A) of the propeller fan (10) to the blade tip (20) of the propeller fan (10) is substantially constant over the entire length of the blade tip (20).

In each blade (14), the length of the blade tip (20) is greater than the length of the blade root (18). In the rotation direction (D) of the propeller fan (10), the front end of the blade tip (20) is located forward of the front end of the blade root (18). In the rotation direction (D) of the propeller fan (10), the rear end of the blade root (18) is located rearward of the rear end of the blade tip (20).

The front edge of each blade (14) in the rotation direction (D) of the propeller fan (10) is a leading edge (22). The rear edge of each blade (14) in the rotation direction (D) of the propeller fan (10) is a trailing edge (24). The leading edge (22) and trailing edge (24) of each blade (14) extend toward the outer peripheral side (the outside in the radial direction of rotation) of the propeller fan (10) from the blade root (18) to the blade tip (20).

The leading edge (22) of each blade (14) is curved into a recessed shape which is recessed rearward in the rotation direction (D) of the propeller fan (10). The trailing edge (24) of each blade (14) is curved into a recessed shape which is recessed forward in the rotation direction (D) of the propeller fan (10). A portion of the trailing edge (24) of each blade (14) closer to a blade root (18) side extends along the leading edge (22). A portion of the trailing edge (24) of each blade (14) closer to a blade tip (20) side extends apart from the leading edge (22) toward the blade tip (20) side.

Each blade (14) is inclined so as to cross a plane orthogonal to the axis (A) of the propeller fan (10). The leading edge (22) of each blade (14) is located closer to one end (an end facing upward in FIG. 2) of the hub (12). On the other hand, the trailing edge (24) of each blade (14) is located closer to the other end (an end facing downward in FIG. 2) of the hub (12). Each blade (14) is configured such that a recessed surface (a surface facing downward in FIG. 2) facing forward in the rotation direction (D) of the propeller fan (10) is a positive pressure surface (26), and a raised surface (a surface facing upward in FIG. 2) facing rearward in the rotation direction (D) of the propeller fan (10) is a negative pressure surface (28).

The ring (16) is provided so as to surround the plurality of blades (14). The ring (16) is formed into an annular ring shape. The inner peripheral surface of the ring 16 is connected to each blade tip (20) of the four blades (14). That is, the four blades (14) are coupled to each other through the ring (16). The ring (16) covers the entirety of each blade (14) from the leading edge (22) to the trailing edge (24) in a side view of the propeller fan (10). Both end portions of the ring (16) are curved to warp toward the outer peripheral side.

In the propeller fan (10), as the four blades (14) rotate, air flows from a suction side, which is the rear side of the propeller fan (10), toward an air blowing side, which is the front side of the propeller fan (10). In this way, air is blown by the air blowing device. Since the ring (16) is provided, the air pushed out by the propeller fan (10) is less likely to flow around the blade tip (20) of each blade (14) from a positive pressure surface (26) side to a negative pressure surface (28) side. This reduces generation of a blade tip vortex.

Shapes of Blades

Figure 4:
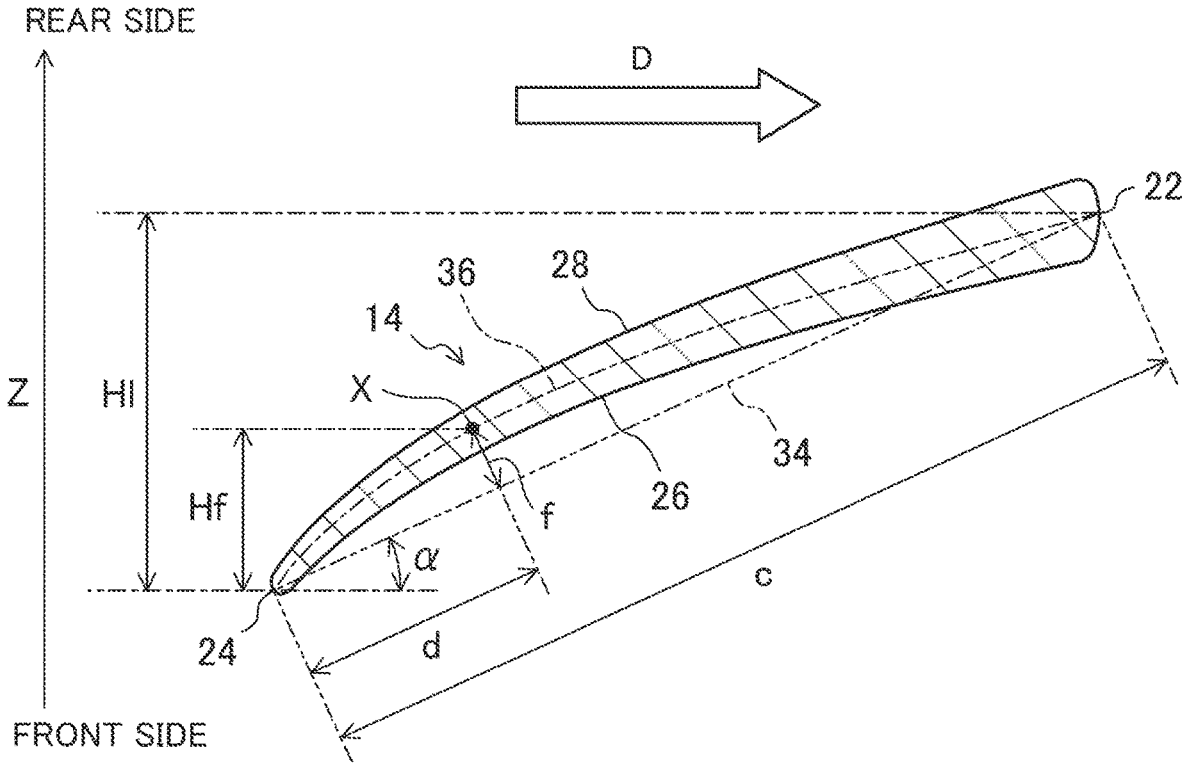
FIG. 4 is a cross-sectional view illustrating, as an example, the cross section of a blade of the propeller fan of the embodiment.

The blade cross section illustrated in FIG. 4 is, in a flattened state, the cross section of one blade (14) located at a distance Rn from the axis (A) of the propeller fan (10), i.e., an arc-shaped cross section about the axis (A). As illustrated in FIG. 4, each blade (14) warps to bulge toward the negative pressure surface (28) side. Each blade (14) has a first portion (30) provided inside in the radial direction of rotation and a second portion (32) provided outside in the radial direction of rotation.

The first portion (30) forms 70% or more, preferably 80% or more of a portion of the blade (14) inside an intermediate location of the blade (14) in the radial direction of rotation. The second portion (32) forms 70% or more, preferably 80% or more of a portion of the blade (14) outside the intermediate location of the blade (14) in the radial direction of rotation. In this example, the inner half of each blade (14) is defined by the first portion (30), and the outer half of each blade (14) is defined by the second portion (32). That is, the first portion (30) and the second portion (32) halves the blade (14) at the intermediate location in the radial direction of rotation.

In the blade cross section illustrated in FIG. 4, a line segment connecting the leading edge (22) and the trailing edge (24) of the blade (14) is a chord line (34). The angle between the chord line (34) and the plane orthogonal to the axis (A) of the propeller fan (10) is an attachment angle $\alpha$. The length of the chord line (34) is a chord line length c. The chord line length c is a value obtained through dividing an arc length $Rn\theta$ having a radius Rn and a center angle $\theta$ by a cosine $\cos\alpha$ with respect to the attachment angle $\alpha$ ($c=Rn\theta/\cos\alpha$). Note that $\theta$ is the center angle of the blade (14) at the location at the distance Rn from the axis (A) of the propeller fan (10) (see FIG. 3), and the unit thereof is radian.

In the blade cross section illustrated in FIG. 4, a line connecting the midpoints of the positive pressure surface (26) and the negative pressure surface (28) is a camber line (36). The distance from the chord line (34) to the camber line (36) is a camber height. The camber height gradually increases in the direction from the leading edge (22) to the trailing edge (24) along the chord line (34), reaches the maximum value halfway between the leading edge (22) and the trailing edge (24), and gradually decreases in the direction from the location, at which the camber reaches the maximum value, toward the trailing edge (24). The maximum value of the camber height is a maximum camber height f.

In the blade cross section illustrated in FIG. 4, the location on the camber line (36) where the camber height reaches the maximum camber height f is a maximum camber location (X). The maximum camber location (X) is set to the vicinity of the midpoint of the chord line length c to form a continuous maximum camber location line (L) indicated by a dashed line in FIG. 3 over the entire length of the blade (14) from the blade root (18) to the blade tip (20) in the radial direction of rotation.

In the blade cross section illustrated in FIG. 4, the height from the trailing edge (24) of the blade (14) to the camber line (36) along the axis (A) in the direction (Z) toward the rear side is an axial height. The axial height of the blade (14) at the leading edge (22) is a leading edge height Hl. The leading edge height Hl is determined according to the attachment angle α and chord line length c of the blade (14). The axial height at the maximum camber location (X) is a maximum camber location height Hf. The maximum camber location height Hf is determined according to the attachment angle α of the blade, the distance d from the trailing edge (24) to the maximum camber location (X), and the camber height f.

The axial height gradually increases from the leading edge (22) to the trailing edge (24). Regarding the axial height of the blade (14) from the trailing edge (24) to the maximum camber location (X), a change range per unit length in the rotation direction (D) of the blade (14) increases toward the leading edge (22) of the blade (14). Regarding the axial height of the blade (14) from the maximum camber location (X) to the leading edge (22), a change range per unit length in the rotation direction (D) of the blade (14) decreases toward the leading edge (22) of the blade (14) or is constant.

Chord Line Length

Figure 5:
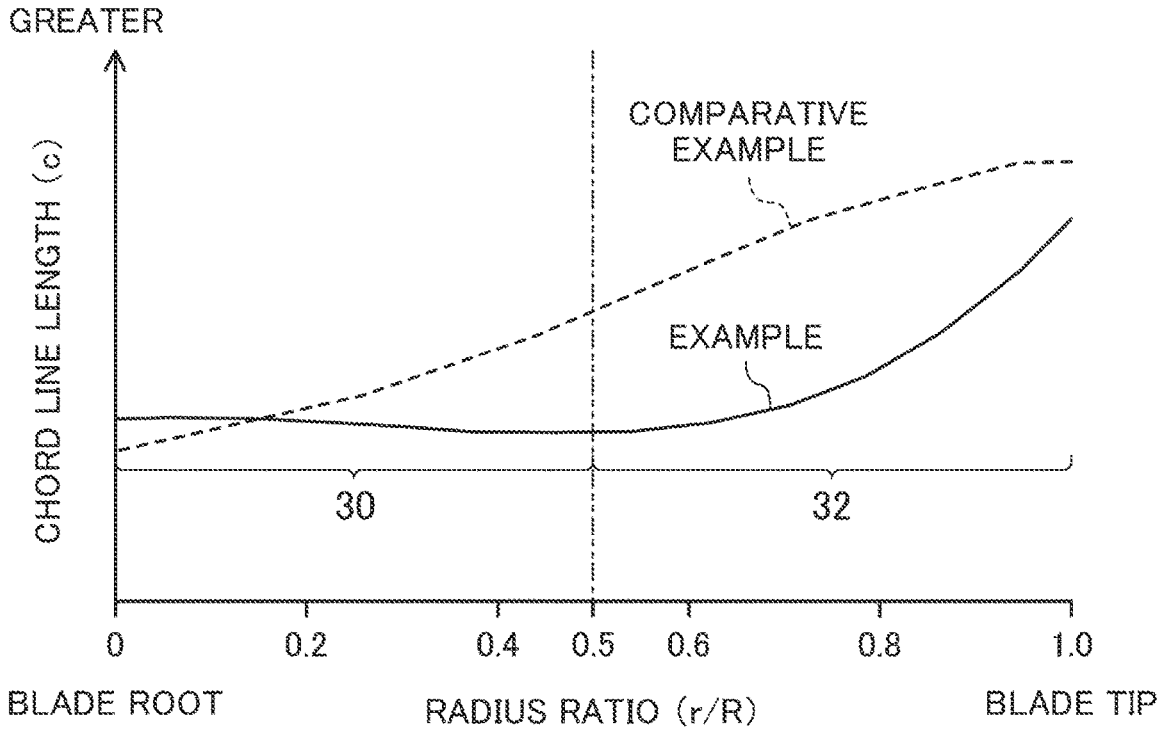
FIG. 5 is a graph illustrating a relationship between a radius ratio and a chord line length in the propeller fan of the embodiment.

As illustrated in FIG. 5, the chord line length c of each blade (14) changes according to a radius ratio which is the ratio (r/R) of the length (r: Rn−Ri) from the blade root (18) at an arbitrary location to the length (R: Ro−Ri) from the blade root (18) to the blade tip (20) in radial direction of rotation. The radius ratio (r/R) indicates the location on the blade (14) from the blade root (18) in the radial direction of rotation. Specifically, the chord line length c is substantially constant at the first portion (30), and gradually increases toward the blade tip (20) at the second portion (32). Here, the chord line length c being "substantially constant" means that the change range of the chord line length c is a length within ±10% with respect to the chord line length c at the blade root (18). The change range of the chord line length c at the first portion (30) is preferably within ±5% of the chord line length c at the blade root (18). Regarding the chord line length c at the second portion (32), the change range per unit length in the radial direction of rotation increases toward the blade tip (20). The chord line length c of each blade (14) is not local maximum at the intermediate portion of the second portion (32), and is maximum at the blade tip (20).

Attachment Angle

Figure 6:
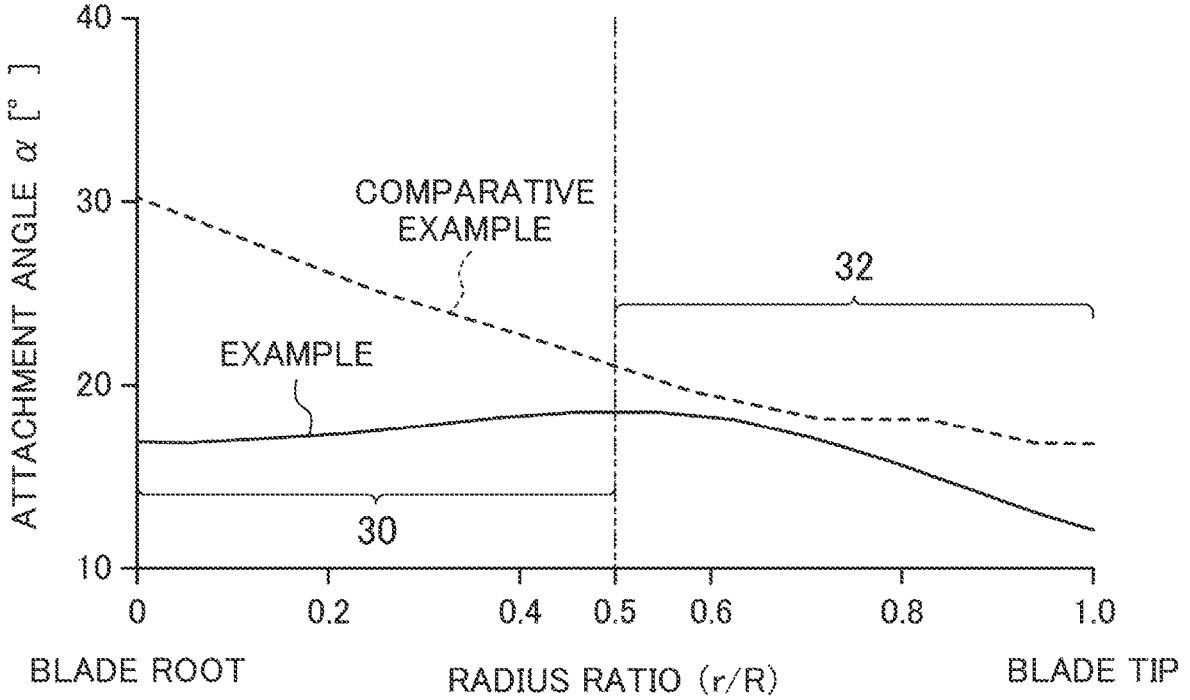
FIG. 6 is a graph illustrating a relationship between the radius ratio and an attachment angle in the blade of the propeller fan of the embodiment.

As illustrated in FIG. 6, in each blade (14), the attachment angle α varies according to the radius ratio (r/R). Specifically, the attachment angle α gradually increases toward the blade tip (20) at the first portion (30), and gradually decreases toward the blade tip (20) at the second portion (32). The degree of increase in the attachment angle α at the first portion (30) is relatively gradual. The degree of decrease in the attachment angle α at the second portion (32) is steeper than the degree of increase in the attachment angle α at the first portion (30). The attachment angle α of each blade (14) is local maximum around an intermediate location in the radial direction of rotation.

Camber Ratio

Figure 7:
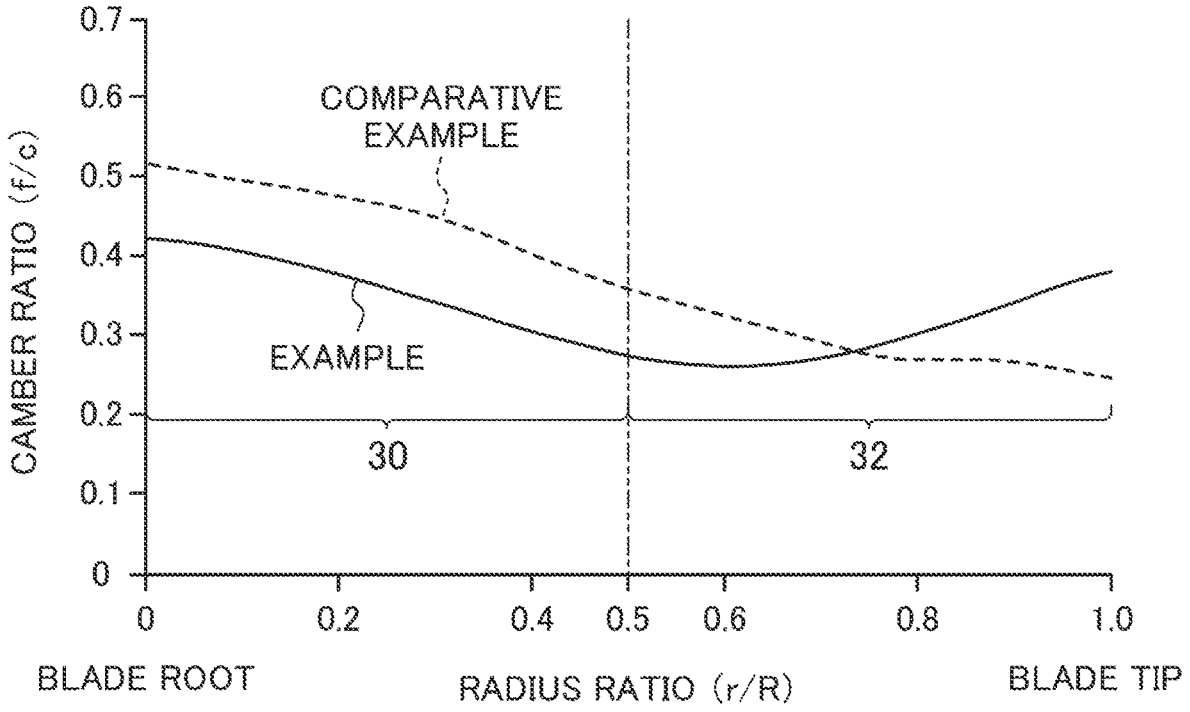
FIG. 7 is a graph illustrating a relationship between the radius ratio and a camber ratio in the blade of the propeller fan of the embodiment.

In the blade cross section illustrated in FIG. 4, the ratio (f/c) of the maximum camber height f to the chord line length c is a camber ratio. As illustrated in FIG. 7, in each blade (14), the camber ratio (f/c) hardly varies according to the radius ratio (r/R). That is, the camber ratio (f/c) is substantially constant over the entire length of the blade (14) from the blade root (18) to the blade tip (20) in the radial direction of rotation. The camber ratio (f/c) of the first portion (30) and the camber ratio (f/c) of the second portion (32) are substantially the same over the entire area of each portion. Here, the camber ratio being "substantially constant" means that the change range of the camber ratio (f/c) is within ±0.5 with respect to the camber ratio (f/c) at the blade root (18). The change range of the camber ratio (f/c) is preferably within ±0.2 with respect to the camber ratio (f/c) at the blade root (18). In this example, the camber ratio (f/c) of each blade (14) is 0.25 or more and 0.45 or less.

Maximum Camber Location Ratio

Figure 8:
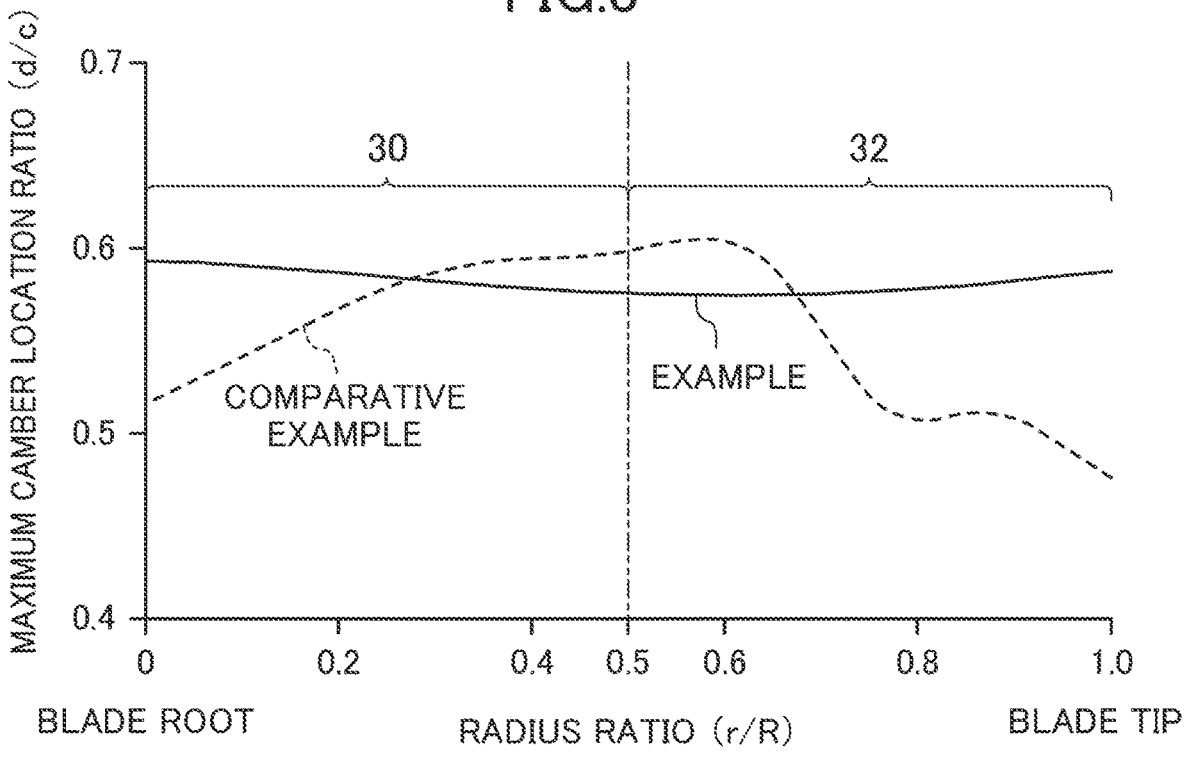
FIG. 8 is a graph illustrating a relationship between the radius ratio and a maximum camber location ratio in the blade of the propeller fan of the embodiment.

In the blade cross section illustrated in FIG. 4, the ratio of the distance from the leading edge (22) of the blade (14) to the maximum camber location (X) to the chord line length c is a maximum camber location ratio. As illustrated in FIG. 8, in each blade (14), the maximum camber location ratio hardly varies according to the radius ratio (r/R). That is, the maximum camber location ratio is substantially constant over the entire length of the blade (14) from the blade root (18) to the blade tip (20) in the radial direction of rotation. The maximum camber location ratio of the first portion (30) and the maximum camber location ratio of the second portion (32) are substantially the same over the entire area of each portion. Here, the maximum camber location ratio being "substantially constant" means that the change range of the maximum camber location ratio is within ±0.5 with respect to the maximum camber location ratio at the blade root (18). The change range of the maximum camber location ratio is preferably within ±0.2 with respect to the maximum camber location ratio at the blade root (18). In this example, the maximum camber location ratio of each blade (14) is 0.55 or more and 0.6 or less.

Axial Height

Figure 9:
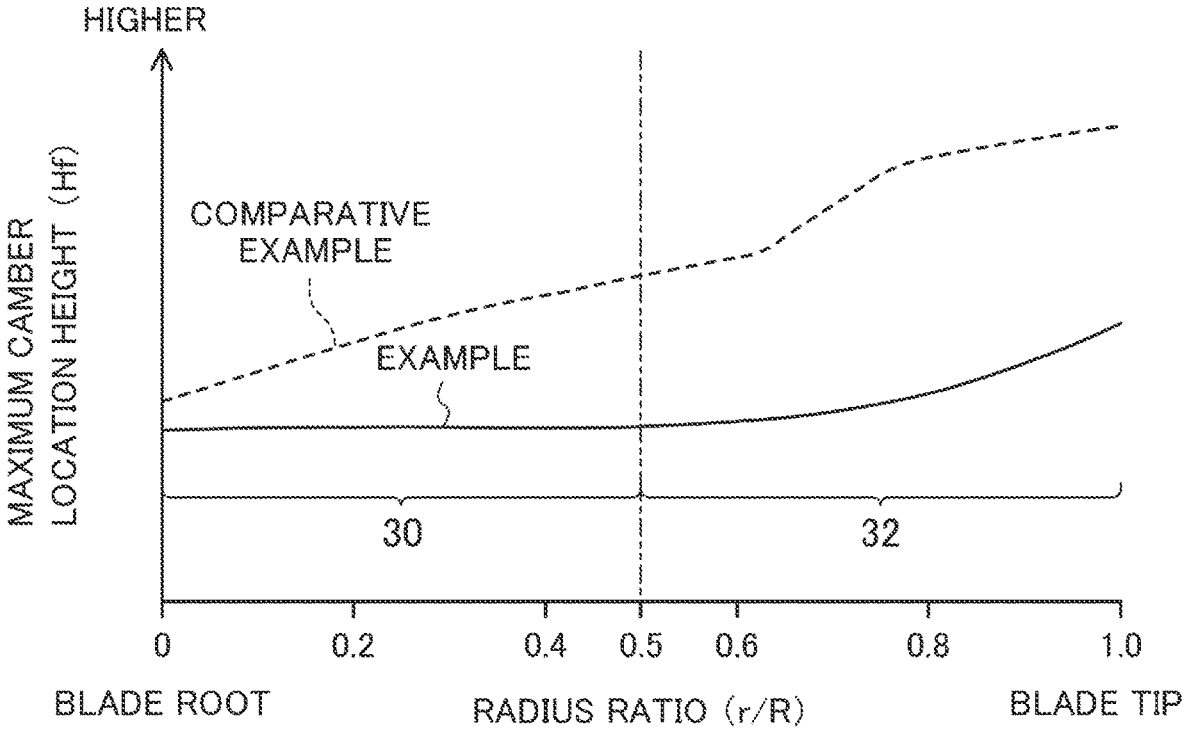
FIG. 9 is a graph illustrating a relationship between the radius ratio and a maximum camber location height in the blade of the propeller fan of the embodiment.

As illustrated in FIG. 9, in each blade (14), the maximum camber location height Hf varies according to the radius ratio (r/R). Specifically, the maximum camber location height Hf is substantially constant at the first portion (30), and gradually increases toward the blade tip (20) at the second portion (32). Here, the maximum camber location height being "substantially constant" means that the change range of the maximum camber location height Hf is within ±10% with respect to the maximum camber location height Hf at the blade root (18). The change range of the maximum camber location height Hf at the first portion (30) is preferably within ±5% with respect to the maximum camber location height Hf at the blade root (18). Regarding the maximum camber location height Hf at the second portion (32), the change range per unit length in the radial direction of rotation increases toward the blade tip (20). The maximum camber location height Hf of each blade (14) is not local maximum at the intermediate portion of the second portion (32), and is maximum at the blade tip (20).

Figure 10:
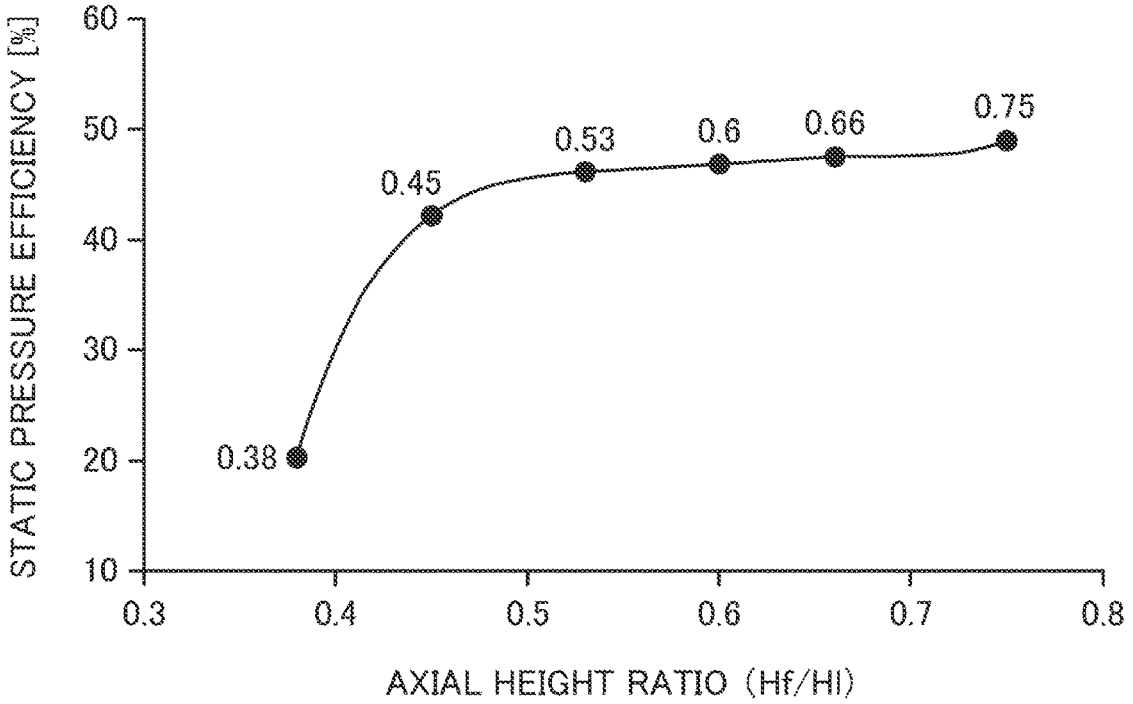
FIG. 10 is a graph illustrating a relationship between an axial height ratio and a static pressure efficiency in the blade of the propeller fan.

In each blade (14), the ratio (Hf/Hl) of the maximum camber location height Hf to the leading edge height Hl is an axial height ratio. As illustrated in FIG. 10, the static pressure efficiency of the air blowing device using the propeller fan (10) sharply increases when the axial height ratio (Hf/Hl) is from 0.38 to 0.45, and gently increases until the axial height ratio (Hf/Hl) reaches 0.75 after the axial height ratio (Hf/Hl) has exceeded 0.45. Thus, the axial height ratio (Hf/Hl) of each blade (14) satisfies 0.45 or more (Hf/Hl≥0.45) at least at the blade root (18). In this example, each blade (14) is designed such that the axial height ratio (Hf/Hl) satisfies 0.45 or more (Hf/Hl≥0.45) over the entire length of the blade (14) from the blade root (18) to the blade tip (20) in the radial direction of rotation.

Performance of Propeller Fan

Figure 11:
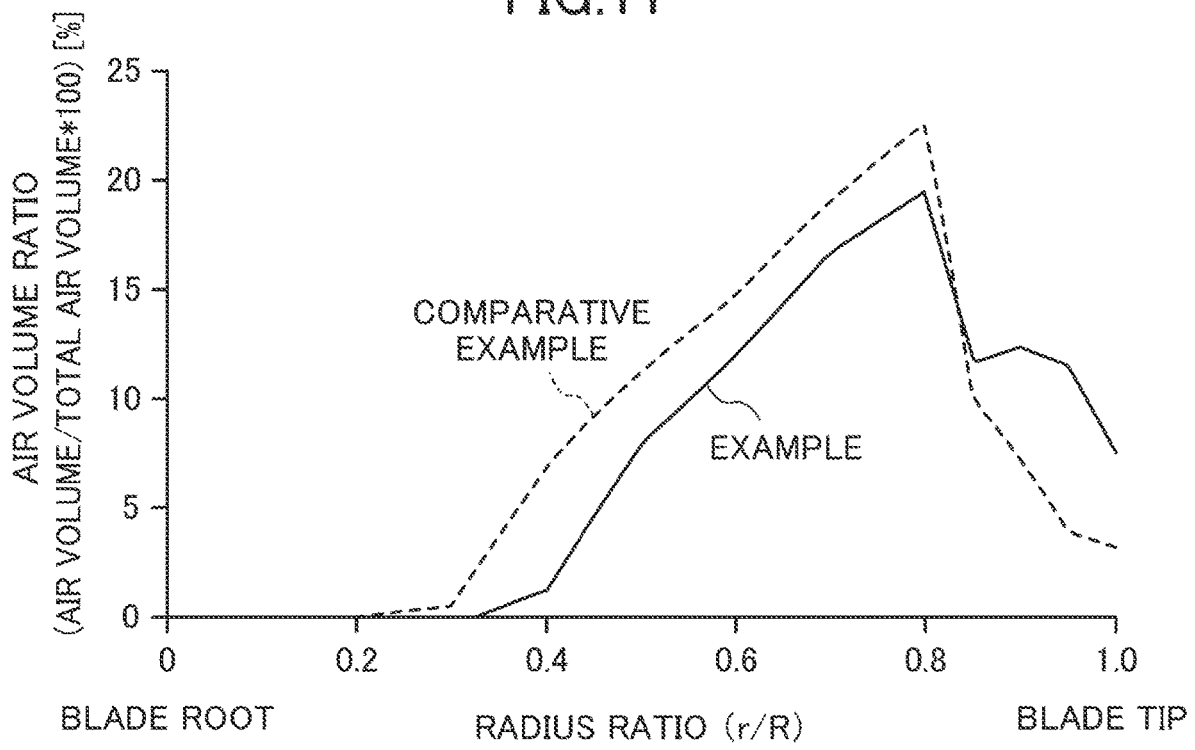
FIG. 11 is a graph illustrating a relationship between the radius ratio and an air volume ratio in the blade of the propeller fan of the embodiment.
Figure 12:
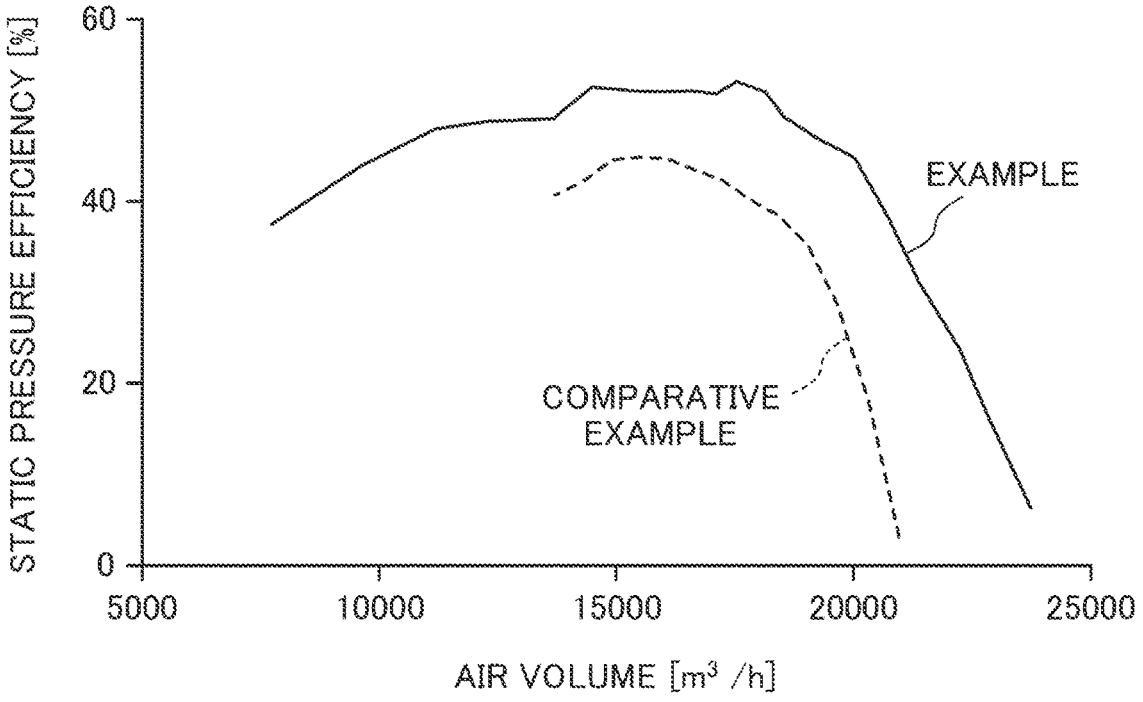
FIG. 12 is a graph illustrating a relationship between an air volume and the static pressure efficiency in the propeller fan of the embodiment.

In FIG. 11, an air volume ratio in association with the radius ratio (r/R) of the propeller fan (10) of this example is indicated by a solid line, and an air volume ratio in association with the radius ratio (r/R) of a propeller fan of a comparative example is indicated by a dashed line. The air volume ratio is the ratio of an air volume at an arbitrary location in the radial direction of the fan (10) to the total air volume of the propeller fan (10). In FIG. 12, a static pressure efficiency in association with the air volume of the air blowing device using the propeller fan (10) of this example is indicated by a solid line, and a static pressure efficiency in association with the air volume of the air blowing device using the propeller fan of the comparative example is indicated by a dashed line.

The propeller fan of the comparative example is configured, as in the propeller fan (10) of this example, such that four blades (14) are arranged at regular angular intervals in the circumferential direction, and includes no ring (16). The propeller fan of the comparative example has a chord line length c indicated by a dashed line in FIG. 5, an attachment angle α indicated by a dashed line in FIG. 6, a camber ratio (f/c) indicated by a dashed line in FIG. 7, a maximum camber location ratio (d/c) indicated by a dashed line in FIG. 8, and a maximum camber location height Hf indicated by a dashed line in FIG. 9.

As illustrated in FIG. 11, the propeller fan (10) of this example is different from the propeller fan of the comparative example in the air volume ratio over the substantially entire area in the radial direction. Specifically, the air volume ratio at a location where the radius ratio (r/R) of the propeller fan (10) of this example is 0.8 or less is lower than the air volume ratio at a location where the radius ratio (r/R) of the propeller fan of the comparative example is 0.8 or less. The location where the radius ratio (r/R) of the propeller fan (10) of this example exceeds 0.8 is significantly higher in the air volume ratio than a location where the radius ratio (r/R) of the propeller fan of the comparative example exceeds 0.8.

In the propeller fan of the comparative example, the maximum camber location (X) is designed to reduce expansion of the blade tip vortex, and therefore, the air volume ratio on the fan outer peripheral side suddenly drops. For this reason, as illustrated in FIG. 12, in the propeller fan of the comparative example, the static pressure efficiency is degraded. On the other hand, in the propeller fan (10) of this example, an effect of increasing the air volume ratio on the fan outer peripheral side can be obtained by a suitable design of the maximum camber location (X). On the outer peripheral side of the propeller fan (10), the peripheral speed when the blades (14) rotate is high and the chord line length c is relatively long, so that the Reynolds number is high. Thus, a boundary layer on the surface of the blade (14) becomes thin, and an energy loss due to dissipation of kinetic energy can be reduced. As a result, as illustrated in FIG. 12, in the propeller fan (10) of this example, the static pressure efficiency is enhanced.

Features of Embodiment

According to the propeller fan (10) of this embodiment, since the ring (16) is connected to each blade tip (20) of the plurality of blades (14), air is less likely to flow around the blade tip (20) from the positive pressure surface (26) side to the negative pressure surface (28) side of the blade (14), thereby making it possible to reduce generation of the blade tip vortex. In each blade (14), the first portion (30) whose axial height at the maximum camber location (X) is substantially constant is provided inside in the radial direction of rotation, and the second portion (32) whose axial height at the maximum camber location (X) increases toward the blade tip (20) is provided outside in the radial direction of rotation. Thus, the workload on the blade tip (20) side of each blade (14), i.e., the outer peripheral side of the propeller fan (10), increases, and a fan efficiency can be enhanced accordingly.

According to the propeller fan (10) of this embodiment, the first portion (30) forms 70% or more of the inner portion of each blade (14), and therefore, the workload inside in the radial direction of rotation is relatively small. On the other hand, the second portion (32) forms 70% or more of the outer portion of each blade (14), and therefore, the workload outside in the radial direction of rotation is relatively great. This is advantageous for increasing the fan efficiency of the propeller fan (10).

According to the propeller fan (10) of this embodiment, the rate of change (the change range per unit length) of the axial height at the maximum camber location (X) at the second portion (32) increases toward the blade tip (20), and therefore, at the second portion (32) of each blade (14), the increment of the workload in association with rotation of the propeller fan (10) increases to the outside in the radial direction of rotation. This is advantageous for increasing the fan efficiency of the propeller fan (10).

According to the propeller fan (10) of this embodiment, the chord line length c of the first portion (30) is substantially constant at each blade (14), and therefore, the workload inside in the radial direction of rotation is relatively small. On the other hand, the chord line length c of the second portion (32) increases toward the blade tip (20) at each blade (14), and therefore, the workload outside in the radial direction of rotation is relatively great. This is advantageous for increasing the fan efficiency of the propeller fan (10).

According to the propeller fan (10) of this embodiment, the rate of change (the change range per unit length) of the chord line length c of the second portion (32) increases toward the blade tip (20), and therefore, at the second portion (32) of each blade (14), the increment of the workload in association with rotation of the propeller fan (10) increases to the outside in the radial direction of rotation. This is advantageous for increasing the fan efficiency of the propeller fan (10).

According to the propeller fan (10) of this embodiment, the blade (14) is designed so as to satisfy Hf/Hl≥0.45. With this configuration, the balance between the camber ratio (f/c) and the maximum camber location ratio (d/c) becomes favorable for increasing the static pressure efficiency.

Other Embodiments

The foregoing embodiment may be modified as follows.

First Variation

Figure 13:
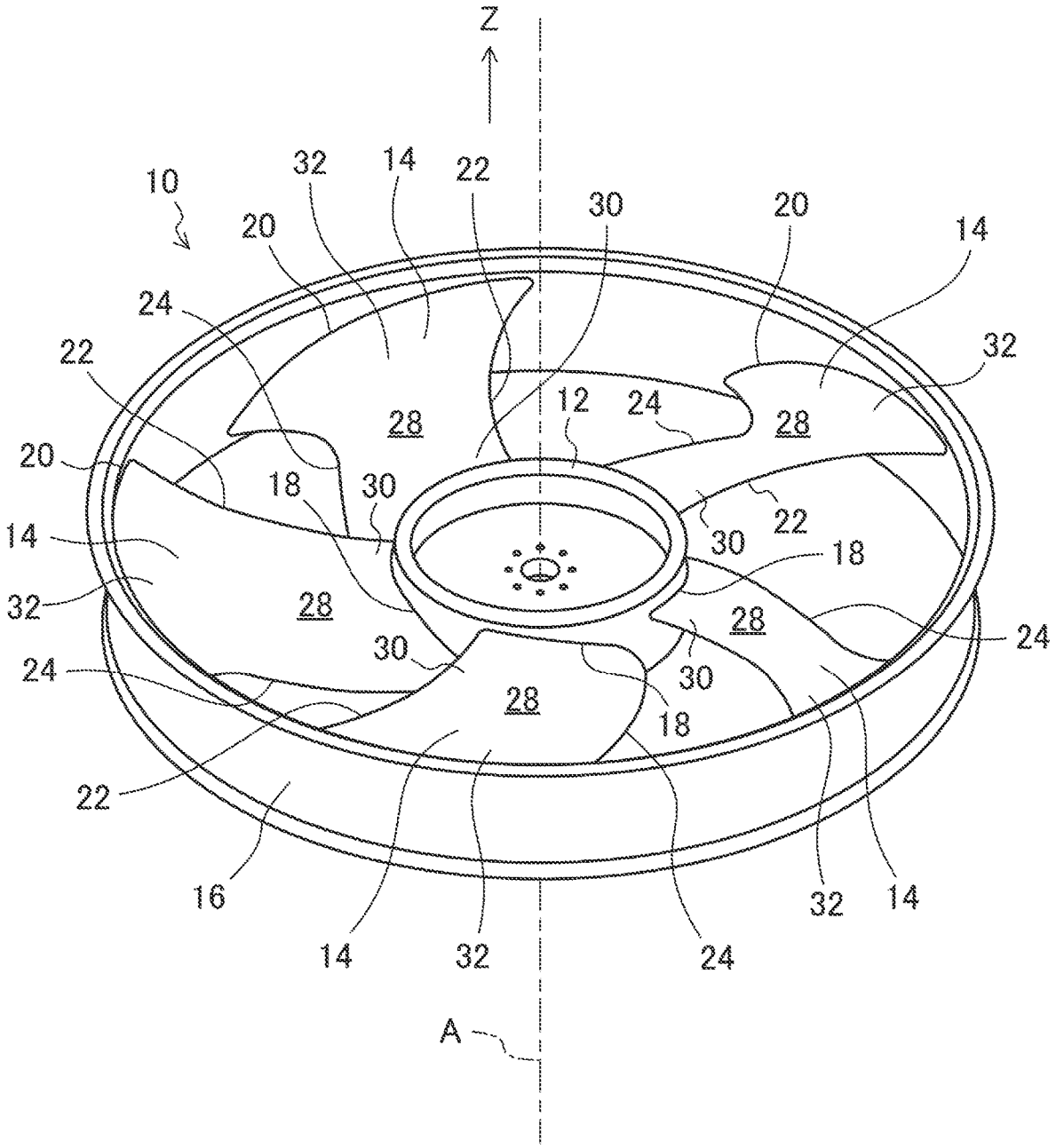
FIG. 13 is a perspective view illustrating a propeller fan of a first variation.

As illustrated in FIG. 13, the propeller fan (10) may include five blades (14). The number of blades (14) included in the propeller fan (10) may be three or less or six or more. In the propeller fan (10), the blades (14) adjacent to each other may partially overlap with each other in a front view or a rear view.

Second Variation

Figure 14:
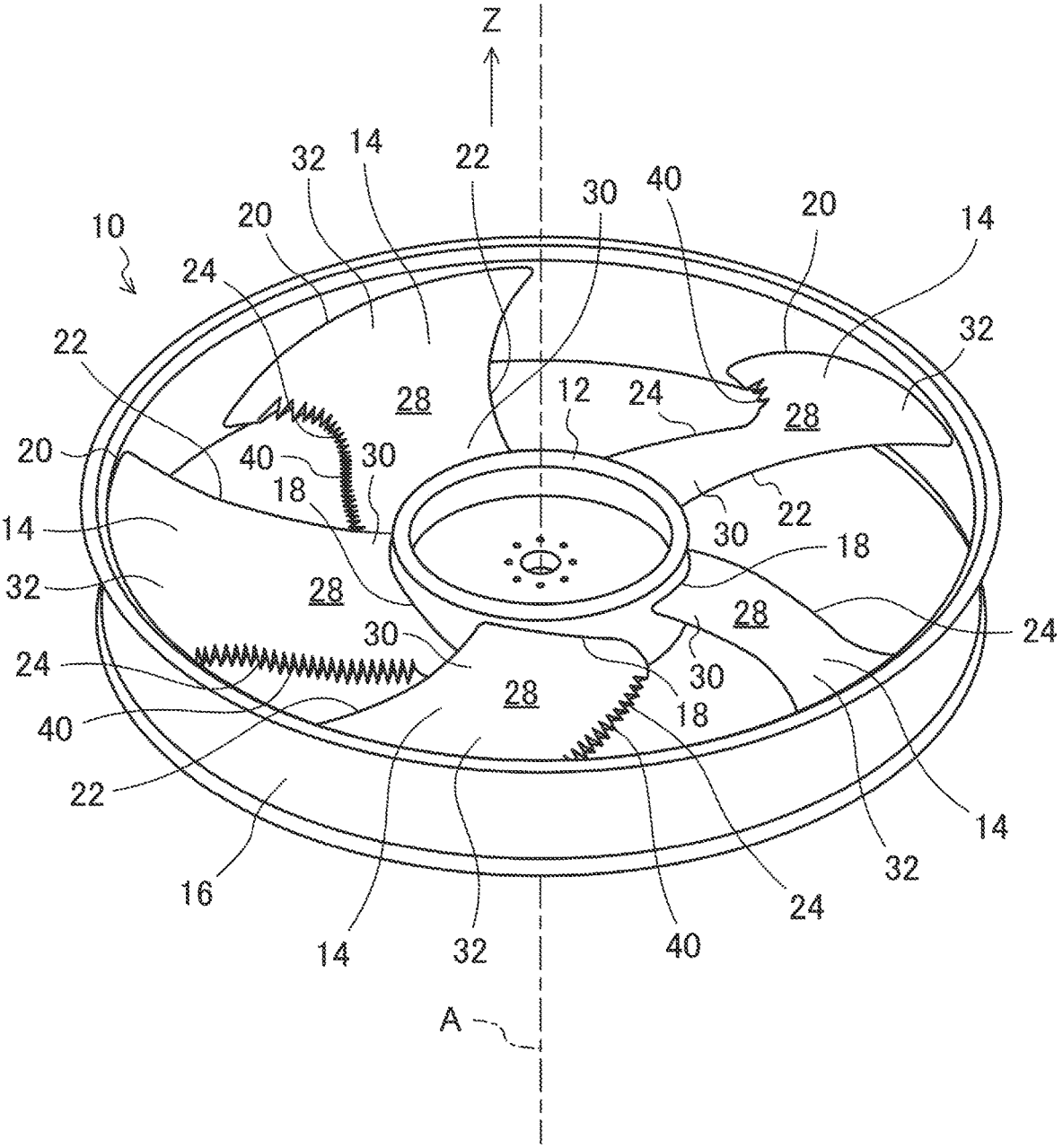
FIG. 14 is a perspective view illustrating a propeller fan of a second variation.

As illustrated in FIG. 14, in the propeller fan (10), the trailing edge (24) of each blade (14) may be provided with serrations (40). The serrations (40) are portions formed into a sawtooth shape. The serrations (40) are provided over the substantially entire trailing edge (24) of each blade (14), for example.

According to the propeller fan (10) of the second variation, the serrations (40) are provided at the trailing edge (24) of each blade (14), and therefore, the serrations (40) can reduce turbulence of air flowing on the negative pressure surface (28) side of the blade (14) and reduce wind noise of the blade (14) due to rotation of the propeller fan (10). Further, it can be expected to increase the fan efficiency of the propeller fan (10).

Other Variations

The portion of the blade (14) formed by the first portion (30) may be about 50% of the inner portion of the blade (14) with respect to the midpoint of the blade (14) in the radial direction of rotation, or may be less than 50%. The portion of the blade (14) formed by the second portion (32) may be about 50% of the outer portion of the blade (14) with respect to the midpoint of the blade (14) in the radial direction of rotation, or may be less than 50%.

While the embodiment and variations thereof have been described above, it will be understood that various changes in form and details may be made without departing from the spirit and scope of the claims. The embodiments and the variations thereof may be combined and replaced with each other without deteriorating intended functions of the present disclosure.

The invention claimed is:

1. A propeller fan comprising:

a hub configured to rotate about an axis;

a plurality of blades, each of the plurality of blades extending outward in a radial direction from an outer peripheral surface of the hub, the radial direction being perpendicular to the axis; and a ring provided to surround the plurality of blades, the ring being connected to a blade tip of each of the plurality of blades, the blade tip being an outer end of each of the plurality of blades in the radial direction, a maximum camber location being on a camber line at a position where a distance from a chord line to the camber line in an arc-shaped cross section of each of the plurality blades about the axis is maximum, and each of the plurality of blades having a first portion and a second portion, the second portion being disposed farther outward in the radial direction than the first portion, the first portion being configured such that an axial height of the maximum camber location is substantially constant among different arc-shaped cross sections of the first portion, and the second portion being configured such that the axial height of the maximum camber location increases toward the blade tip, the axial height being measured from an axial position of a trailing edge of the blade to an axial position of the camber line along an axial direction parallel to the axis, the trailing edge being a rear edge of each of the plurality of blades in a rotation direction of the propeller fan.

2. The propeller fan of claim 1, wherein the first portion forms at least 70% of an inner section of each blade, the inner section being an entire portion of each blade that is disposed radially inward of an intermediate location of each blade, and the second portion forms at least 70% of an outer section of each blade, the outer section being an entire portion of each blade that is disposed radially outward of the intermediate location of each blade.

3. The propeller fan of claim 2, wherein in the second portion, a change amount of the axial height of the maximum camber location per unit length in the radial direction increases toward the blade tip.

4. The propeller fan of claim 3, wherein a chord line length is substantially constant among different arc-shaped cross sections of the first portion, and the chord line length increases toward the blade tip anions different arc-shaped cross sections of the second portion.

5. The propeller fan of claim 4, wherein in the second portion, a change amount of the chord line length per unit length in the radial direction increases toward the blade tip.

6. The propeller fan of claim 3, wherein each of the plurality of blades is configured to satisfy the relationship $Hf/Hl \geq 0.45$, Hf being the axial height at the maximum camber location, and Hl being the axial height of a leading edge, at a blade root, the leading edge being a front edge of each blade in the rotation direction thereof and the blade root being an inner end of each blade in the radial direction.

7. The propeller fan of claim 2, wherein a chord line length is substantially constant among different arc-shaped cross sections of the first portion, and the chord line length increases toward the blade tip among different arc-shaped cross sections of the second portion.

8. The propeller fan of claim 7, wherein in the second portion, a change amount of the chord line length per unit length in the radial direction increases toward the blade tip.

9. The propeller fan of claim 7, wherein each of the plurality of blades is configured to satisfy the relationship $Hf/Hl \geq 0.45$, Hf being the axial height at the maximum camber location, and Hl being the axial height of a leading edge, at a blade root, the leading edge being a front edge of each blade in the rotation direction thereof and the blade root being an inner end of each blade in the radial direction.

10. The propeller fan of claim 2, wherein each of the plurality of blades is configured to satisfy the relationship $Hf/Hl \geq 0.45$, Hf being the axial height at the maximum camber location, and Hl being the axial height of a leading edge, at a blade root, the leading edge being a front edge of each blade in the rotation direction thereof and the blade root being an inner end of each blade in the radial direction.

11. The propeller fan of claim 1, wherein in the second portion, a change amount of the axial height of the maximum camber location per unit length in the radial direction increases toward the blade tip.

12. The propeller fan of claim 11, wherein a chord line length is substantially constant among different arc-shaped cross sections of the first portion, and the chord line length increases toward the blade tip among different arc-shaped cross sections of the second portion.

13. The propeller fan of claim 12, wherein in the second portion, a change amount of the chord line length per unit length in the radial direction increases toward the blade tip.

14. The propeller fan of claim 11, wherein each of the plurality of blades is configured to satisfy the relationship Hf/Hl≥0.45, Hf being the axial height at the maximum camber location, and Hl being the axial height of a leading edge, at a blade root, the leading edge being a front edge of each blade in the rotation direction thereof and the blade root being an inner end of each blade in the radial direction.

15. The propeller fan of claim 1, wherein a chord line length is substantially constant among different arc-shaped cross sections of the first portion, and the chord line length increases toward the blade tip among different arc-shaped cross sections of the second portion.

16. The propeller fan of claim 15, wherein each of the plurality of blades is configured to satisfy the relationship Hf/Hl≥0.45, Hf being the axial height at the maximum camber location, and Hl being the axial height of a leading edge, at a blade root, the leading edge being a front edge of each blade in the rotation direction thereof and the blade root being an inner end of each blade in the radial direction.

17. The propeller fan of claim 15, wherein in the second portion, a change amount of the chord line length per unit length in the radial direction increases toward the blade tip.

18. The propeller fan of claim 17, wherein each of the plurality of blades is configured to satisfy the relationship Hf/Hl≥0.45, Hf being the axial height at the maximum camber location, and Hl being the axial height of a leading edge, at a blade root, the leading edge being a front edge of each blade in the rotation direction thereof and the blade root being an inner end of each blade in the radial direction.

19. The propeller fan of claim 1, wherein each of the plurality of blades is configured to satisfy the relationship Hf/Hl≥0.45, Hf being the axial height at the maximum camber location, and Hl being the axial height of a leading edge, at a blade root, the leading edge being a front edge of each blade in the rotation direction thereof and the blade root being an inner end of each blade in the radial direction.

20. The propeller fan of claim 1, wherein the t a edge of each blade is provided with a serration.

* * * * *